United States Patent [19]

Ryer et al.

[11] 4,092,127

[45] May 30, 1978

[54] ANTI-DIESELING ADDITIVE FOR SPARK IGNITION ENGINES

[75] Inventors: Jack Ryer, East Brunswick; Martin F. Dooley, Edison, both of N.J.

[73] Assignee: Exxon Research & Engineering Co., Linden, N.J.

[21] Appl. No.: 752,467

[22] Filed: Dec. 20, 1976

[51] Int. Cl.[2] ..... C10L 1/14; C10L 1/22

[52] U.S. Cl. ..... 44/63; 44/71

[58] Field of Search ..... 44/63, 71

[56] References Cited

U.S. PATENT DOCUMENTS 3,087,936 4/1963 LeSuer ..... 252/33.3

3,282,955 11/1966 LeSuer ..... 252/51.5 A

*Primary Examiner*—Daniel E. Wyman

*Assistant Examiner*—Mrs. Y. Harris-Smith

*Attorney, Agent, or Firm*—Roland A. Dexter; Frank T. Johmann

[57] ABSTRACT

The combination of an oil-soluble borated acylated nitrogen compound (e.g., borated polybutenylsuccinic anhydride reacted with polyamine) and solvent oil is usefully added to gasoline fuel for combustion in a spark ignition internal combustion engine exhibiting dieseling (also known as after-run or run-on) whereby said combustion results in alleviation of said dieseling.

5 Claims, No Drawings

ANTI-DIESELING ADDITIVE FOR SPARK IGNITION ENGINES

BACKGROUND OF THE INVENTION

The invention relates to a combination of a borated ashless dispersant and a solvent oil especially useful in gasoline fuels for alleviating an abnormal combustion phenomenon of spark ignition engines. More specifically, it relates to a combination of a borated nitrogen containing dispersant known as a lubricating oil additive to improve the sludge dispersancy property of lubricating oils and a mineral oil which is added to gasoline fuel to alleviate dieseling in spark ignition engines, a phenomenon which occurs when said engine continues to run when the ignition is turned off.

Basically, an automotive engine is an energy converter, releasing mechanical energy or power in two related steps. First, the chemical energy in gasoline is converted to heat energy by burning the gasoline in the engine's combustion chambers. Secondly, some of this heat energy causes the combustion gases to expand, forcing each of the pistons down and producing mechanical power.

For efficient power production, the conversion of chemical energy to heat energy must occur in an orderly fashion at the proper time in the engine cycle. In a normal engine cycle, the spark-ignited flame spreads across the combustion chamber burning the gasoline smoothly and compressing the unburned fuel-air mixture ahead of it. In addition to being compressed, the "end gas" ahead of the flame front receives heat radiated from the advancing flame. If the end-gas temperature and pressure remain below critical levels, the flame front will consume all the fuel in a uniform manner providing normal combustion. Unfortunately, various factors including engine design and operation and combustion-chamber deposits may act to produce abnormal combustion; a process wherein a flame front is started either prior to or after spark ignition and includes a condition in which the fuel charge is consumed at extremely high rates.

Abnormal cumbustion can be categorized into: spark knock which is recurrent and repeatable in terms of audibility and controllable by spark advance; surface ignition whereby the fuel-air charged is ignited by overheated valves, spark plugs, glowing combustion-chamber deposits or any other hot spot in the combustion chamber; and, dieseling (also known as run-on and after-run).

Surface ignition is an uncontrolled ignition which may occur before the spark plug ignites the charge (preignition) or after normal ignition (postignition). This abnormal combustion can lead to power loss, engine roughness, knock and other audible noise, runaway ignition and destruction of engine parts. To prevent uncontrolled ignition of the fuel by glowing combustion-chamber deposits and sparkplug fouling by engine deposits, deposit modifiers such as alkyl or aryl phosphates, alkyl phosphines and alkyl borinates have been reported as added to gasolines to alter the chemical compositions of the deposits making them less likely to glow and thereby cause uncontrolled fuel ignition. U.S. Pat. No. 2,975,135 teaches that lead-carbonaceous deposits can be attacked by incorporating a fuel soluble organic boron compound in a liquid leaded motor fuel (column 1, lines 48–50).

Dieseling is an abnormal combustion phenomenon that occurs when a spark ignition engine continues to run after the ignition is turned off. This problem has existed for many years and has been widely investigated. However, dieseling seems to be occurring more frequently with late-model cars, particularly when these cars operate on low-octane gasolines. A vehicle study, reported in "SAE Transaction", Volume 81, 720085 entitled "Influence of Engine Fuel Factors on After Run" by J. Bensen of the General Motors Corp., was conducted to gain a better understanding of the factors that influence after-run. Engine operating variables, such as high idle speed, lean idle mixture, and retarded basic spark timing, all increased after-run frequency by increasing the throttle opening (intake charge density). Reduced Research-octane number (RON) of the gasoline also increased after-run frequency, but Motor-octane number (MON) and hydrocarbon composition did not have any effect. The author concluded that after-run, i.e., dieseling, is probably caused by compression ignition rather than surface ignition, and may be related to high-charge density in the cylinders after the ignition is turned off. He suggested only a mechanical method of preventing after-run which was to install an "anti-dieseling solenoid," an electromechanical device that closes the throttle when the ignition is turned off. He also concluded that preventing after-run by adjusting engine-operating variables conflicts with current automobile exhaust emission-control systems that require high idle speeds, lean mixtures, and retarded spark timing.

Dieseling also represents an environmental hazard since after-run exhaust is reported to contain about 125 times more aldehydes than engine idle exhaust, cause eye irritation and has an obnoxious odor.

The addition of boron-containing substances to the combustion chamber of spark ignition engines is further exemplified by U.S. Pat. No. 3,303,208 which teaches the introduction of metaborate ester-amine reaction products by addition to gasoline; U.S. Pat. No. 3,000,916 which teaches that boron levels of 10 to 20 parts per million in gasoline of a borated reaction product of an N-alkyl alkylene polyamide with a polymeric long-chain unsaturated polybasic carboxylic acid provides excellent rust inhibition; and, U.S. Pat. No. 2,725,857 which teaches that the surface deposits of combustion chambers can be reduced by coating the combustion chamber surfaces with a coating containing an inorganic boron compound, such as copper borate, by introduction of the composition through the spark-plug openings of the engine. It is also known that borated oil additives are excellent sludge dispersants as seen in U.S. Pat. Nos. 3,087,936, 3,254,025, 3,281,428 and 3,282,955.

The additives of the prior art and particularly the additives which have been taught and useful for the addition to gasolines appear to have little or no effect on the dieseling type of abnormal combustion phenomenon, however, they do reduce the RON of the gasoline by their presence. This suggests that with the lower octane number of the gasolines being offered in today's market because of the obligation of reducing the tetraethyl lead content, there will be a greater tendency for dieseling to occur. Should the ignition timing be retarded to avoid detonation, there would be the additional tendency for run-on because of the higher exhaust system temperatures, higher operational temperatures of the engine and higher temperatures of the liquid coolant. The individual effect of each of these factors may well be small but together they promote dieseling in today's spark ignition engines.

In view of the foregoing, there is an urgent need to provide an anti-dieseling additive for gasoline and/or lubricating oils to be used in spark ignition engines, particularly in view of the decreased RON of the gasoline and the use of smaller engines to converse fuel for such engines are not susceptible to material retardation of spark timing in order to prevent dieseling.

SUMMARY OF THE INVENTION

It has now been found that the addition of the combination of an oil-soluble borated acyl nitrogen compound, preferably borated polybutenylsuccinic anhydride reacted with an alkylene polyamine such as tetraethylene pentamine and a solvent oil having a kinematic viscosity of from 8 to 20, preferably 10 to 18, centistokes (cs) at 99° C. to distillate fuel for subsequent combustion in a spark ignition internal combustion engine exhibiting dieseling results in alleviation of said dieseling when said combination is employed in a ratio of 1 part by weight of said nitrogen compound to from about 2 to 40, preferably about 4 to 26, optimally about 8, parts by weight of said solvent oil and said combination is present in an amount sufficient to provide from about 80 to 400, preferably about 160 to 300, optimally about 250, parts per million of boron to said distillate fuel, preferably gasoline.

Thus in its broadest concept, the subject matter of the invention is a fuel to which has been added, in an amount sufficient to provide from about 80 to 400 parts per million by weight of boron of an anti-dieseling combination of: (a) 1 part by weight of an oil-soluble acyl nitrogen compound characterized by the presence within its structure of a substantially saturated hydrocarbon-substituted polar group selected from the class consisting of acyl, acylimidoyl and acyloxy radicals wherein the substantially saturated hydrocarbon substituent contains at least about 16 to 180 aliphatic carbon atoms and a nitrogen-containing group characterized by a nitrogen atom attached directly to said polar material; and, (b) from about 2 to 40 parts by weight of a solvent oil having oxidation stability and a viscosity ranging from 8 to 20 cs. at 99° C.

In preferred form, the combination is limited to a nitrogen compound derived from hydrocarbyl substituted dicarboxylic acid materials wherein said hydrocarbyl substituent has a $(\overline{M}_n)$ ranging from about 700 to 1,600, optimally from about 900 to 1500 and from about 1 to about 3 moles of said dicarboxylic acid material is reacted with about 1 mole of tetraethylene pentamine.

DETAILED DESCRIPTION OF THE INVENTION

BORATED ACYL NITROGEN COMPOUND

The borated acyl nitrogen compound is of that class of oil-soluble dispersants broadly described in U.S. Pat. Nos. 3,087,936 and 3,282,955 (they are incorporated herein by reference thereto) as the reaction product of an oil-soluble acylated nitrogen compound characterized by the presence within its structure of a substantially saturated hydrocarbon-substituted polar group selected from the class consisting of acyl, acylimidoyl, and acyloxy radicals wherein the substantially saturated hydrocarbon substituent contains at least about 16 aliphatic carbon atoms and a nitrogen-containing group characterized by a nitrogen atom attached directly to said polar radical and a boron compound. For the purposes of this invention, the hydrocarbon substituent of these acyl nitrogen compounds, preferably has $(\overline{M}_n)$ ranging from about 200 to 2,500, preferably from about 700 to 1,600 and optimally from about 900 to 1,500. All $(\overline{M}_n)$ values set forth in this specification have been determined by Vapor Pressure Osmometry (VPO).

The relative polar groups of the acyl nitrogen compound are represented by the structural configurations as follows:

$$\text{acyl}, R_3-\overset{\overset{\displaystyle O}{\|}}{C}-;\ \text{acylimidoyl},\ R_3-\overset{\overset{\displaystyle NR_4}{\|}}{C}-;\ \text{and,}$$

$$\text{acyloxy},\ R_3-\overset{\overset{\displaystyle O}{\|}}{C}-O-$$

where $R_3$ is the substantially saturated hydrocarbon substituent, i.e., hydrocarbyl (including a preferred alkenyl) substituent, of the carboxylic acid material and $R_4$ represents a hydrogen radical or a hydrocarbyl group (including polar substituted hydrocarbyls, e.g., Cl substituted).

The nitrogen-containing group of the acylated nitrogen compositions of this invention is derived from compounds characterized by a radical having the structural configuration $$-\underset{\underset{\displaystyle |}{}}{N}-H \text{ and}$$

the two remaining valences of the nitrogen atom of the above $$-\underset{\underset{\displaystyle |}{}}{N}-H$$

radical preferably are satisfied by hydrogen, amino, or organic radicals bonded to said nitrogen atom through direct carbon-to-nitrogen linkages. Thus, the compounds from which the nitrogen-containing group may be derived include aliphatic amines, aromatic amines, heterocyclic amines or carbocyclic amines. The amines may be primary or secondary amines and preferably are polyamines such as alkylene amines, arylene amines, cyclic polyamines, and the hydroxy-substituted derivatives of such amines.

The borated acyl nitrogen compound is readily prepared by forming an acylated nitrogen intermediate by the reaction of a substantially hydrocarbon-substituted succinic acid-producing compound having at least about 16 aliphatic carbon atoms in the substantially hydrocarbon-substituent with at least about one-half equivalent of an amido compound having the formula $$H-\underset{\underset{\displaystyle R}{|}}{N}-R'$$

wherein R is selected from the class consisting of hydrogen and hydrocarbon radicals and R' is selected from the class consisting of amino, cyano, carbamyl, and guanyl radicals and reacting said acylated nitrogen intermediate with a boron compound selected from the class consisting of boron oxide, boron halides, boron acids, ammonium salts of boron acids, and esters of boron acids in an amount to provide from about 0.3 to 0.9 wt. % of boron based on the total weight of borated acyl nitrogen compound.

The substantially saturated hydrocarbon-substituted polar group can readily be obtained according to this invention from a hydrocarbyl substituted carboxylic acid material which includes monocarboxylic and polycarboxylic acids, acid halides, esters, and anhydrides as well as imides and amides derived from ammonia or a lower primary amine, and also mixtures of such compounds. The preferred carboxylic acid material is a hydrocarbyl substituted dicarboxylic acid material, i.e., acid or anhydride, or ester which includes unsaturated $C_4$ to $C_{10}$ dicarboxylic acid, or anhydrides or esters thereof, such as fumaric acid, itaconic acid, maleic acid, maleic anhydride, chloromaleic acid, dimethyl fumarate, etc., which are substituted with a hydrocarbyl group, usefully a hydrocarbon chain containing at least 16 carbons (branched or unbranched) and includes long hydrocarbon chains of up to about 180 carbons, generally an olefin polymer chain.

In general, these hydrocarbyl substituted dicarboxylic acid materials and their preparation are well known in the art, for example, see U.S. Pat. Nos. 3,219,666; 3,172,892; 3,272,746; as well as being commercially available, e.g., polyisobutylene succinic anhydride.

The dicarboxylic acid material can be illustrated by an alkenyl substituted anhydride which may contain a single alkenyl radical or a mixture of alkenyl radicals variously bonded to the cyclic succinic anhydride group, and is understood to comprise such structures as:

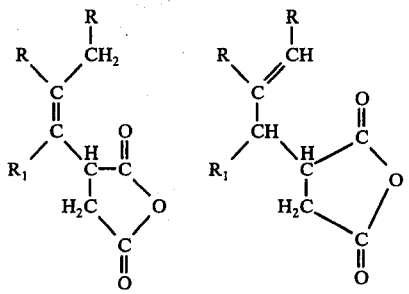

wherein R is hydrogen or lower hydrocarbyl and $R_1$ is hydrocarbyl or substituted hydrocarbyl having from 16 to about 180 carbons, and preferably from 50 to about 120 carbons. The anhydrides can be obtained by well-known methods, such as the Ene reaction between an olefin and maleic anhydride or halo-succinic anhydride or succinic ester (U.S. Pat. No. 2,568,876). In branched olefins, particularly branched polyolefins, R may be hydrogen or methyl and $R_1$ at least a $C_{16}$ long chain hydrocarbyl group. However, the exact structure may not always be ascertained and the various R and $R_1$ groups cannot always be precisely defined in the Ene products from polyolefins and maleic anhydride.

Suitable olefins include butene, isobutene, pentene, decene, dodecene, tetradecene, hexadecene, octadecene, eicosene, and polymers of propylene, butene, isobutene, pentene, decene and the like, and halogen-containing olefins. The olefins may also contain cycloalkyl and aromatic groups.

With 2-chloromaleic anhydride and related acylating agents, alkenylmaleic anhydride reactants are formed. Derivatization of these reactants also afford useful imide or oxazoline products.

Preferred olefin polymers for reaction with the unsaturated dicarboxylic acids are polymers comprising a major molar amount of $C_2$ to $C_5$ monoolefin, e.g., ethylene, propylene, butylene, isobutylene and pentene. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor amount of the copolymer monomers, e.g., 1 to 20 mole % is a $C_4$ to $C_{18}$ non-conjugated diolefin, e.g., a copolymer of isobutylene and butadiene; or a copolymer of ethylene, propylene and 1,4-hexadiene; etc.

The olefin polymers will usually have $(\overline{M}_n)$s within the range of about 600 and about 2,500, more usually between about 700 and about 1,600. Particularly useful olefin polymers have $(\overline{M}_n)$s of about 900 to 1,500 with approximately one terminal double bond per polymer chain. An especially valuable starting material for a highly potent dispersant additive are polyalkenes, e.g., polyisobutylene, having about 70 carbons.

The monocarboxylic acids and derivatives thereof may be obtained by oxidizing a monohydric alcohol with potassium permanganate or by reacting a halogenated high molecular olefin polymer with a ketene. Another convenient method for preparing the monocarboxylic acids involves the reaction of metallic sodium with an acetoacetic ester or a malonic ester of an alkanol to form a sodium derivative of the ester and the subsequent reaction of the sodium derivative with a halogenated high molecular weight hydrocarbon such as brominated wax or brominated polyisobutene. Other methods include the reaction of a high molecular weight olefin with ozone; the Haloform Reaction; the reaction of an organometallic complex (such as lithium-olefin complex) with carbon dioxide; the reaction of a chlorinated hydrocarbon with a lactone; the reaction of a chlorinated hydrocarbon with chloromaleic acid or mercapto-maleic anhydride; reaction of a chlorinated hydrocarbon with an olefinic acid producing compound such as acrylic acid, methacrylic acid, maleimide, etc.

The monocarboxylic and polycarboxylic acid anhydrides are obtained by dehydrating the corresponding acids. Dehydration is readily accomplished by heating the acid to a temperature above about 70° C., preferably in the presence of a dehydration agent, e.g., acetic anhydride. Cyclic anhydrides are usually obtained from polycarboxylic acids having the acid radicals separated by no more than three carbon atoms such as substituted succinic or glutaric acids, whereas linear polymeric anhydrides are obtained from polycarboxylic acids having the acid radicals separated by four or more carbon atoms.

The preferred intermediates for boration, i.e., acyl nitrogen compounds obtained from hydrocarbyl substituted dicarboxylic acid material, are essentially described as the imides and diimides, preferably diimides resulting from the reaction of 1 to 3, preferably about 1.5 to 2.5, molar proportions of the dicarboxylic acid material with one molar proportion of a nitrogen compound having one or more amino groups. Such a preferred compound can be represented by the structural formula

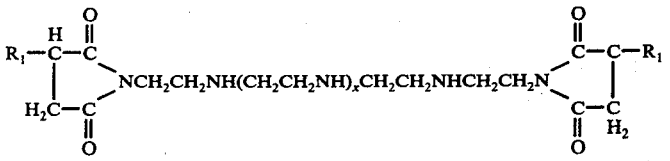

wherein X is a number from 0 to 5, etc., when 2 molar proportions of the dicarboxylic acid material is reacted with 1 molar proportion of said nitrogen compound having one or more amine groups and $R_1$ is the same as earlier defined.

Useful nitrogen compounds for preparing these intermediates include mono- and polyamines of about 2 to 60, e.g., 3 to 20 total carbon atoms and about 1 to 12, e.g., 2 to 6 nitrogen atoms in the molecule. The amine compounds may be hydrocarbyl amines or may include hydroxy groups, alkoxy groups, amide groups or may be cyclic in structure such as imidazolines and the like. Preferred amines both as noted above generally and for preparation of said imides and diimides are aliphatic, saturated amines including those of the general formulae:

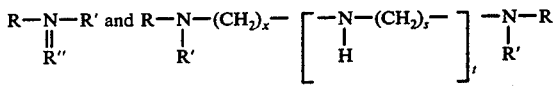

wherein R, R′ and R″ are independently selected from the group consisting of hydrogen; $C_1$ to $C_{12}$ straight or branched chain alkyl radicals; $C_1$ to $C_{12}$ alkoxy; $C_2$ to $C_6$ alkylene radicals; $C_2$ to $C_{12}$ hydroxy or amino alkylene radicals; and $C_1$ to $C_{12}$ alkylamino $C_2$ to $C_6$ alkylene radicals; *s* is a number of from 2 to 6, preferably 2 to 4; and *t* is a number of from 0 to 10, preferably 2 to 6.

Non-limiting examples of suitable amine compounds include: mono- and di-tallow amines; 1,2-diaminoethane; 1,3-diaminopropane; 1,4-diaminobutane; 1,6-diaminohexane; diethylenetriamine; triethylene tetramine, tetraethylene pentamine; 1,2-propylene diamine; di-(1,2-propylene) triamine, di-(1,3-propylene) triamine, N,N-dimethyl-1,3-diaminopropane; N,N-di-(2-aminoethyl) ethylene diamine; N,N-di-(2-hydroxyethyl)-1,3-propylene diamine; 3-dodecyloxypropylamine; N-dodecyl-1,3-propane diamine; tris-hydroxymethylaminomethane, diisopropanol amine, and diethanol amine.

Other useful amine compounds include: alicyclic diamines such as 1,4-bis-(aminomethyl) cyclohexane, and heterocyclic nitrogen compounds such as imidazolines and N-aminoalkyl piperazines of the general formula:

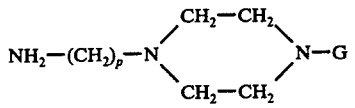

wherein G is independently selected from the group consisting of hydrogen and ω aminoalkylene radicals of from 1 to 3 carbon atoms; and *p* is an integer of from 1 to 4. Non-limiting examples of such amines include 2-pentadecyl imidazoline; N-(2-aminoethyl) piperazine; N-(3-aminopropyl) piperazine; and N,N′-di-(2-aminoethyl) piperazine.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly(ethyleneamines) compounds having a composition approximating tetraethylene pentamine (used for the preparation of the acyl nitrogen compounds of the subsequent Examples herein) are available commercially under the trade name Polyamine 400 (PA-400), marketed by Jefferson Chemical Co., New York, N.Y. Similar material may be made by the polymerization of aziridine, 2-methylaziridine and 1-aziridine ethanol.

Still other amines with amino groups separated by hetero atom chains such as polyethers or sulfides can be used.

Amination of the dicarboxylic acid material is usefully carried in a solution reaction with the dicarboxylic acid material dissolved in a solvent such as mineral oil. The formation of the imide dispersants in high yield can be effected by adding from about 0.3 to 1, preferably about 0.4 to 0.7, molar proportions of alkylene polyamine per molar proportion of dicarboxylic acid material of the nitrogen compound to said solution and heating the mixture at 140° to 165° C. until the appropriate amount of water of reaction is evolved.

As earlier discussed, boration is readily accomplished by treating said acyl nitrogen dispersant with a boron compound selected from the class consisting of boron oxide, boron halides, boron acids and esters of boron acids in an amount to provide from about 0.1 atomic proportion of boron for each mole of said acyl nitrogen composition to about 10 atomic proportion of boron for each atomic proportion of nitrogen of said acyl nitrogen composition. Usefully the dispersants of the inventive combination contain from about 0.3 to 0.9 wt. % boron based on the total weight of said borated acyl nitrogen compound. The boron, which appears to be in the product as dehydrated boric acid polymers (primarily $(HBO_2)_3$), attaches chemically to the dispersant imides and diimides as amine salts, e.g., the metaborate salt of said diimide.

Treating is readily carried by adding from about 1 to 3 wt. % (based on the weight of said acyl nitrogen compound) of said boron compound, preferably boric acid which is most usually added as a slurry to said acyl nitrogen compound and heating with stirring and at from about 135° to 165° C. for from 1 to 5 hours followed by nitrogen stripping at said temperature ranges. Filter the borated product, if desired.

SOLVENT OIL

The solvent oils used according to this invention are soluble in the hydrocarbon fuel facilitating distribution of the dispersant throughout the fuel while at the same time providing a beneficial washing action on the intake manifold and intake valves of the spark ignition engine.

By soluble is meant that at least 1% by weight of the solvent oil will dissolve in the hydrocarbon fuel at 20° C.

Suitable solvent oils are hydrocarbons of moderately high viscosity, i.e., a kinematic viscosity at 99° C. of from about 8 to 20, preferably about 10 to 18 centistokes (measurement of viscosity is according to ASTM D445-74). Illustrative of the useful solvent oils are polymers and copolymers of $C_2$ to $C_{28}$ alpha-olefins having a number average molecular weight ($\overline{M}_n$) of from about 600 to 1,000 and mineral oils boiling with the range of from about 315° C. to above 540. Preferred among these are polypropylene having a ($\overline{M}_n$) of from about 700 to 900, polyisobutylene having a ($\overline{M}_n$) of from about 700 to 900 and mineral oils boiling within the range of from about 370° to 510° C.

The mineral oils used in this invention can be paraffinic and/or naphthenic of the moderately high boiling range and high kinematic viscosity. The paraffinic oils contain saturated straight chain and branched hydrocarbons. The naphthenic oils are comparable to the paraffinic oils in that they are saturated hydrocarbons but made up of methylene groups arranged in rings.

The paraffinic and naphthenic oils are oxidatively stable. They provide beneficial washing action on the intake manifold, intake valve and also serve as a means of transporting the acyl nitrogen dispersant into the various cylinders of an automobile engine. Both oils have low Conradson carbon residue, i.e., from 0.01 to 0.1 wt. % (ASTM D189-52).

Illustrative of two preferred solvent oils are Paraffinic A and Naphthenic A which have the physical characteristics set forth in Table I. Diluents for the solvent oils which may be employed as desired to facilitate handling are generally materials of lower viscosity such as mineral spirits, light solvent oil, naphtha, turpentine and aromatics such as xylene. Usually an anti-dieseling package will contain up to about 90 wt. % of the diluent.

TABLE I

| | Paraffinic A | Naphthenic A |
|---|---|---|
| Viscosity at 99° C in centistokes | 10 | 13.6 |
| Boiling Range (atmospheric) ° C | | |
| IBP | 371 | 332 |
| 10% | 452 | 412 |
| 50% | 481 | 468 |
| 95% | 517 | 523 |
| FBP | 522 | 543 |
| Silica Gel Analysis Wt% | | |
| Saturates | 83.1 | 73.7 |
| Aromatics | 15.7 | 25.1 |
| Polar compounds | 1.2 | 1.2 |

THE BORATED ACYL NITROGEN COMPOUND AND SOLVENT OIL COMBINATION

The combination of oil-soluble borated acyl nitrogen dispersant and solvent oil is conventionally added to the fuel by admixture with the fuel in the fuel tank. The dispersant must be sufficiently soluble in the solvent oil at about 0° C so that the combination according to the invention can provide the requisite levels of boron in the fuel to which the combination is added.

As noted in general, the anti-dieseling additive-oil combination of the invention will comprise one part by weight of the borated acyl nitrogen reaction product per about 2 to 40, preferably 4 to 26, optimally 6 to 10 parts by weight of said mineral solvent oil. The hydrocarbon fuel to which the anti-dieseling combination can be added includes not only gasoline fuels derived from petroleum but middle distillate fuels such as kerosene and No. 2 and 3 residual fuels. The useful combination may be conveniently dispensed in the marketplace in a packaged container for addition to the fuel tank, e.g., to provide from 0.2 to 1 fluid once per gallon (e.g., about 0.15 to 0.8 cc per liter) of fuel. Typically, a 11 oz. can containing about 5 g. of the combination diluted with 6 oz. of xylene would be added to a fuel tank containing about 20 gallons of gasoline.

Other gasoline additives such as dyes, anti-oxidants such as alkylated phenols, phenylene diamines, substituted amines and the like, metal deactivators such as N,N'-disalicylidene-1,2-diaminopropane and the like, carburetor detergents such as fatty acid amides, anti-icers, methylcarbitol and the like, corrosion inhibitors such as linoleic acid dimer and the like can also be present in the gasoline compositions including the concentrates of above of the present invention; these additives can, if desired, also be added as concentrate mixes or additive fluids to the gasoline composition.

This invention will be further understood by reference to the following examples, which include preferred embodiments of the invention.

EXAMPLE 1

A borated derivative of the reaction product of polyisobutenylsuccinic anhydride and an alkylene polyamine was prepared by first condensing 2.2 moles of polyisobutenylsuccinic anhydride, having a Saponification Number of 112 and a ($\overline{M}_n$) of 980, dissolved in Solvent Neutral 150 mineral oil to provide a 50 wt. % solution with 1 mole of tetraethylene pentamine (thereafter noted as TEPA). The polyisobutenylsuccinic anhydride solution was heated to about 150° C with stirring and the polyamine was charged into the reaction vessel over a 4-hour period which was thereafter followed by a 3-hour nitrogen strip. The temperature was maintained from about 140° to 165° C. during both the reaction with the TEPA and the subsequent stripping. While the resulting imidated product was maintained at a temperature of from about 135° to about 165° C., a slurry of 1.4 moles of boric acid in mineral oil was added over a 3-hour period which was thereafter followed by a final 4-hour nitrogen strip. After filtration and rotoevaporation, the concentrate (50 wt. % of the reaction product) contained about 1.6 wt. % nitrogen and 0.35 wt. % boron and had a total base number (TBN) of about 30. The product has a ($\overline{M}_n$) of about 2420.

EXAMPLE 2

In the same manner as Example 1, 2.2 moles of polyisobutenylsuccinic anhydride (Sap. No. of 103 and an $\overline{M}_n$ of about 1300) was utilized in place of the polyisobutenylsuccinic anhydride of Example 1. The resulting concentrate (50 wt. % active ingredient) analyzed for 1.46% nitrogen and 0.32% boron.

EXAMPLE 3

In the same manner as Example 1, 1.3 moles of polyisobutenylsuccinic anhydride (Sap. No. of 112 and a $M_n$ of about 980) was condensed with 1 mole of TEPA. The resulting finished concentrate (50 wt. % of the reaction product) contained about 2.0 wt. % nitrogen and about 0.35 wt. % boron.

EVALUATION OF THE INVENTIVE COMBINATION IN ANTI-DIESELING TESTS

A 0.3 wt. % package consisting of 0.028 wt. % of the concentrate of Example 1, 0.11 wt. % of Paraffinic A and 0.162 wt. % xylene was added to a 20 gallon tank of a 1972 Ford Torino vehicle which was experiencing dieseling (after-run) for periods up to 1 minute after switch off of the ignition. It was found that after driving about 400 miles on fuel containing the anti-dieseling additive that dieseling was eliminated.

Similar alleviation of dieseling was noted with the following vehicles as recorded in Table II.

TABLE II

| Car | Passenger Car | Period of Dieseling | Tankfuls of Gas Consumed Before Dieseling Eliminated (approximate miles driven) |
|---|---|---|---|
| 1 | 1972 Chevrolet Camaro | 15/20 sec. | 2 (400) |
| 4 | 1972 Ford Torino | 45 to 60 sec. | 2 (400) |
| 2 | 1968 Pontiac Bonneville | 20 min. | 3 (700) |
| 3 | 1972 Dodge Dart | 8 sec. | 1 (200) |
| 5 | 1972 Chevrolet | 10 sec. | 3 (880) |
| 6 | 1973 Mercury | 10 sec. | 3 (600) |

For purposes of this disclosure the hydrocarbon solvent oils include oxygenated hydrocarbons such as polyethylene glycols and polypropylene glycols, preferably having a $(\overline{M}_n)$ ranging from about 700 to 900 and polyglycerol esters, preferably having a $(\overline{M}_n)$ ranging from about 700 to 900.

In concentrate form, the fuel additive combination of the invention consists essentially of 1 part by weight of a boron containing acyl nitrogen compound and from about 2 to 40 parts by weight of a solvent oil having a kinematic viscosity at 99° C of from 8 to 20 centistokes, said concentrate containing from about 0.007 to 0.3, preferably 0.01 to 0.18 wt. % boron and from about 0.03 to 1.4 wt. % nitrogen, said wt. % based on the total weight of said concentrate. As noted this concentrate can be diluted with up to about 900% of a liquid hydrocarbon diluent of lower viscosity, i.e., less than 8 cs at 99° C, to decrease the viscosity, however, it is preferred to dilute said concentrate by admixture preferably with from about 50 to 200%, optimally about 80 to 100% of said lower viscosity diluent. The dilution is useful to facilitate addition of the additive combination of the invention to a fuel such as that which has a major proportion of hydrocarbon in the gasoling boiling range of 20° to 230° C.

The invention in its broader aspect is not limited to the specific details shown and described and departures may be made from such details without departing from the principles of the invention and without sacrificing its chief advantages.

What is claimed is:

1. A method for treating an automotive vehicle having a gasoline spark ignition internal combustion engine which is dieseling, by adding to the fuel tank of said vehicle, about 0.2 to 1.0 fluid ounce, per gallon of gasoline, of a gasoline additive concentrate consisting essentially of 1 part by weight of a boron containing acyl nitrogen compound and from about 2 to 40 parts by weight of a solvent oil having a kinematic viscosity at 99° C. of from 8 to 20 centistokes, said concentrate containing from about 0.007 to 0.3 wt. % boron and from about 0.03 to 1.4 wt. % nitrogen, wherein said boron containing acyl nitrogen compound is characterized by the presence within its structure of a substantially saturated hydrocarbon-substituted polar group selected from the class consisting of acyl, acylimidoyl, and acyloxy radicals wherein the substantially saturated hydrocarbon substituent contains from about 16 aliphatic to 180 aliphatic carbon atoms, and a nitrogen-containing group characterized by a nitrogen atom attached directly to said polar radical, and wherein said boron containing acyl nitrogen compound contains from 0.3 to 0.9 wt. % boron.

2. A method according to claim 1 wherein said boron containing acyl nitrogen compound is obtained from the reaction of about 2 molar proportions of a poly(-butenyl) substituted succinic anhydride material with said poly(butenyl) substituent having a $(M_n)$ of from about 700 to 1,600 with about 1 molar proportion of tetraethylene pentamine at a temperature of from about 140° to about 165° C. until about 2 molar proportions of water has evolved followed by condensation with boric acid at a temperature of from about 135° to about 165° C.

3. A method according to claim 1 wherein said concentrate is admixed with up to 900% by weight of a liquid hydrocarbon diluent having a kinematic viscosity of less than about 8 centistokes at 99° C.

4. Gasoline containing about 80 to 400 parts per million of boron based on the total weight of said fuel, said boron being obtained from the combination of 1 part by weight of a boron containing acyl nitrogen compound dissolved in from 2 to 40 parts by weight of a mineral solvent oil having a kinematic viscosity ranging from 8 to 20 at 99° C., said boron containing centistokes acyl nitrogen compound consisting of the reaction product of a boron compound selected from the class consisting of boron oxide, boron halides, boron acids and esters of boron acids, with a succinimide of 1 to 3 molar proportions of hydrocarbyl succinic anhydride reacted with a molar proportion of polyamine which is a hydrocarbyl amine of about 3 to 20 carbon atoms and about 2 to about 6 nitrogen atoms; wherein said hydrocarbyl group is a polymer of $C_2$ to $C_5$ monoolefin, said polymer having a molecular weight of about 600 to about 2,500.

5. A method according to claim 1, wherein said boron containing acyl nitrogen compound is the reaction product of a boric acid or boron oxide with the reaction product of 1 to 3 molar proportions of hydrocarbyl succinic anhydride reacted with a molar proportion of hydrocarbyl polyamine of about 3 to 20 carbon atoms and about 2 to about 6 nitrogen atoms, and wherein said hydrocarbyl group of said succinic anhydride is a polymer of $C_2$ to $C_5$ monoolefin, said polymer having a molecular weight of about 600 to 2,500.

* * * * *